US006575617B2

(12) United States Patent
Fleischli et al.

(10) Patent No.: US 6,575,617 B2
(45) Date of Patent: Jun. 10, 2003

(54) STATIC MIXER WITH PROFILED LAYERS

(75) Inventors: Markus Fleischli, Winterthur (CH); Thomas Grütter, Oberdürnten (CH); Thomas Uwe Fischer, Rielasingen-Worblingen (DE); Werner Koller, Effretikon (CH)

(73) Assignee: Sulzer Chemtech AG, Winterthur (CH)

( * ) Notice: Subject to any disclaimer, the term of this patent is extended or adjusted under 35 U.S.C. 154(b) by 33 days.

(21) Appl. No.: 09/848,934

(22) Filed: May 3, 2001

(65) Prior Publication Data

US 2001/0038576 A1 Nov. 8, 2001

(30) Foreign Application Priority Data

May 8, 2000 (EP) ..... 00810391

(51) Int. Cl.[7] ..... B01F 5/06
(52) U.S. Cl. ..... 366/337
(58) Field of Search ..... 261/112.2; 366/336, 366/337, 340; 48/180.1, 189.4, 189.6; 138/37, 38, 39, 40, 42, 44

(56) References Cited

U.S. PATENT DOCUMENTS 2,940,168 A * 6/1960 Monroe
3,051,452 A * 8/1962 Nobel
3,466,151 A * 9/1969 Sicard et al.
3,785,620 A * 1/1974 Huber
3,918,688 A 11/1975 Huber
4,111,402 A 9/1978 Barbini
4,614,440 A * 9/1986 King
4,731,229 A * 3/1988 Sperandio
4,884,894 A 12/1989 Hashimoto
5,407,274 A 4/1995 Woerheide
5,605,399 A * 2/1997 King
6,379,035 B1 * 4/2002 Kubo et al.

FOREIGN PATENT DOCUMENTS

DE 3229486 A1 2/1984
EP 0697374 A1 2/1996

OTHER PUBLICATIONS

Patent Abstracts of Japan, vol. 004, No. 085 (C–015), Jun. 18, 1980 & JP 55 049133 A (Kuromatsu Tokumitsu), Apr. 9, 1980, Abstract, Figures.
Paul, M.H., et al. "Statische Mischer und ihre Anwendung", *Chem.–Ing.–Tech* 52 (1980) No. 4, pp. 285–291.

* cited by examiner

*Primary Examiner*—Tony G. Soohoo
*Assistant Examiner*—David Sorkin
(74) *Attorney, Agent, or Firm*—Townsend and Townsend and Crew LLP

(57) ABSTRACT

A static mixer includes profiled layers which are arranged in a ring space and which contain mutually crossing flow channels which are inclined relative to a central axis. A fluid mixture is to be transported in the axial direction in the presence of a mixing action. Each layer extends over a surface which forms a closed or largely closed periphery transverse to the axis. Each layer comprises equivalent channels which extend on an inner or outer side of the layer over at least approximately equally long distances from a first to a second cross-section of the ring space, so that each channel imposes an azimuthal velocity component onto the fluid mixture which flows through it which is substantially equally large for all equivalent channels.

9 Claims, 4 Drawing Sheets

Fig.1
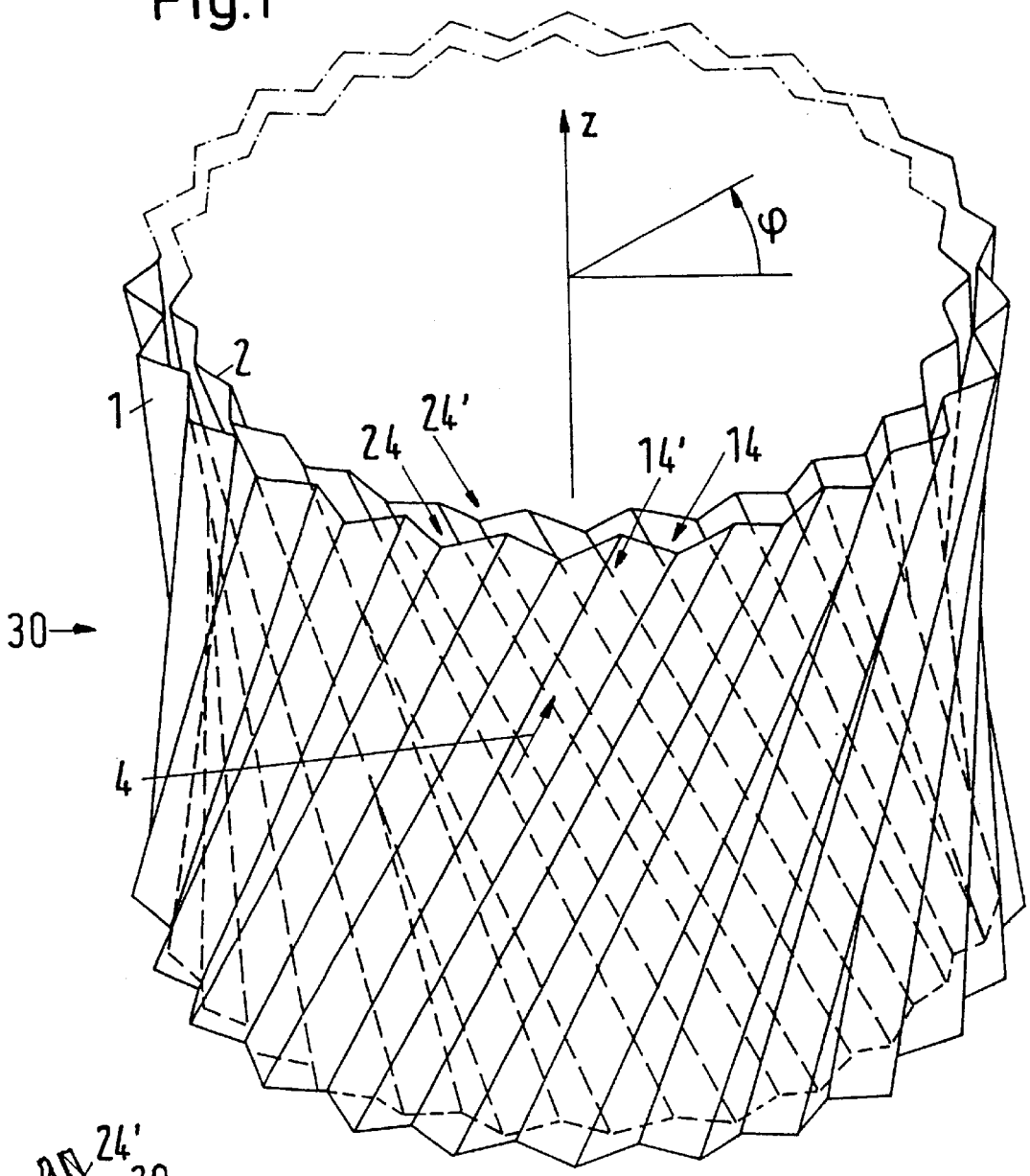
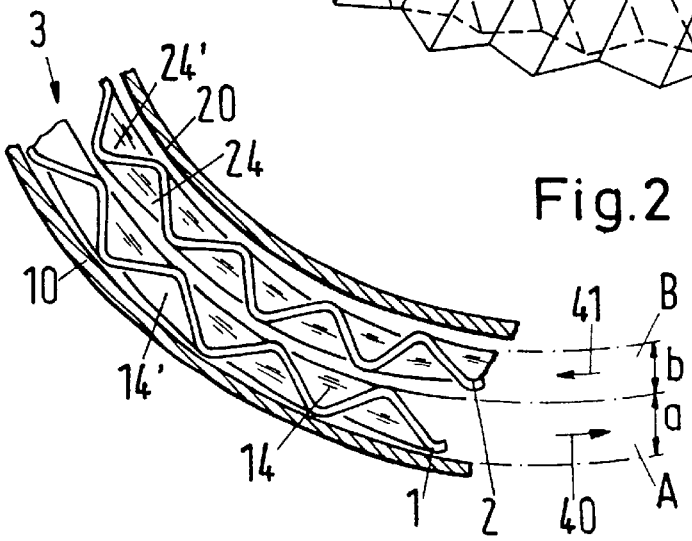
Fig.2

STATIC MIXER WITH PROFILED LAYERS

BACKGROUND OF THE INVENTION

The invention relates to a static mixer with profiled layers and to uses of a mixer of this kind.

In static mixers fluids which flow through fixed installations are homogenized by these installations. There is a large variety of constructional forms. In most static mixers the installations are built in in the form of similar elements in a pipe or a channel. In this they are regularly arranged so that a homogenizing of the components which are to be mixed results over the entire pipe cross-section. Static mixers are also known in which the installations; are in each case arranged in a ring space between two concentric walls. In a review article with the title "Statische Mischer und ihre Anwendung" (M. H. Pahl, E. Muschelknautz; Chem.-Ing.-Techn. 52 (1980) No. 4, pp. 285–291) a mixer of this kind is described (FIG. 1*e*): A series of in each case four twisted baffle plates are secured alternatingly left-handed and right-handed on a cylindrical inner body.

A static mixer with a ring-space shape in which corrugated layers form a cross channel structure with inclined, openly crossing flow channels is known from EP-A 0 697 374. The layers are planar and parallel to a main flow direction.

There are tasks in connection with homogenizations of fluids, for the solution of which ring-space mixers present themselves particularly advantageous. One example: In drilling for petroleum and/or natural gas a drilling channel is produced in which a ring-space-like channel remains open between a jacket pipe and a drilling rod. Material which is set free in the boring head and which can comprise a fluid mixture of liquids (water, petroleum) and gases is conveyed in the axial direction through the ring space. At a depth and at a vertical distance from the deposits the advance of bores of this kind are as a rule turned round from the vertical direction into a direction in which the bore extends horizontally in the extreme case. A large number of bores of this kind are produced which radiate from a central bore toward the periphery of a field from which natural gas and/or petroleum is to be won. In the conveying of the materials to be won the individual bores as a rule yield material mixtures of differing quality. Monitoring devices are provided for monitoring the quality which can be pushed into the drilling channels down to the depth of the deposits. With the help of sensors in the monitoring devices the proportions of the phases (oil, water and/or gas) in the fluid mixture which flows through can be determined.

In order to ensure representative measurement results it is necessary in the monitoring of the quality for the different phases of the fluid mixture, which have different densities, to flow through the measurement regions of the sensors with a uniform distribution. Therefore static mixer elements are to be built into a homogenization region which is placed ahead of the monitoring device. Since phases of different densities segregate in a horizontal or inclined pipe, the static mixer must be formed in such a manner that a segregation of this kind is largely prevented or, if it has already set in, can be reversed. This property is largely lacking in the known ring-space mixers.

SUMMARY OF THE INVENTION

It is an object of the invention to create a static mixer for a fluid mixture which consists of phases of different density and which is to be transported in the axial direction through a ring space, with it being possible for the axis of the ring space to be horizontal or inclined.

The static mixer comprises profiled layers which are arranged in a ring space and which contain mutually crossing flow channels which are inclined relative to a central axis. A fluid mixture is to be transported in the axial direction in the presence of a mixing action. Each layer extends over a surface which forms a closed or largely closed periphery transverse to the axis. Each layer comprises equivalent channels which extend on an inner or outer side of the layer over at least approximately equally long distances from a first to a second cross-section of the ring space, so that each channel imposes an azimuthal velocity component onto the fluid mixture flowing through it which is substantially equally large for all equivalent channels.

In the following the invention will be explained with reference to the drawings.

BRIEF DESCRIPTION OF THE DRAWINGS

FIG. 1 illustrates two concentric layers of a mixer in accordance with the invention which form a cross channel structure, FIG. 2 is part of a cross-section through the mixer in accordance with the invention.

DETAILED DESCRIPTION OF SPECIFIC EXEMPLARY EMBODIMENTS

Figure 3:
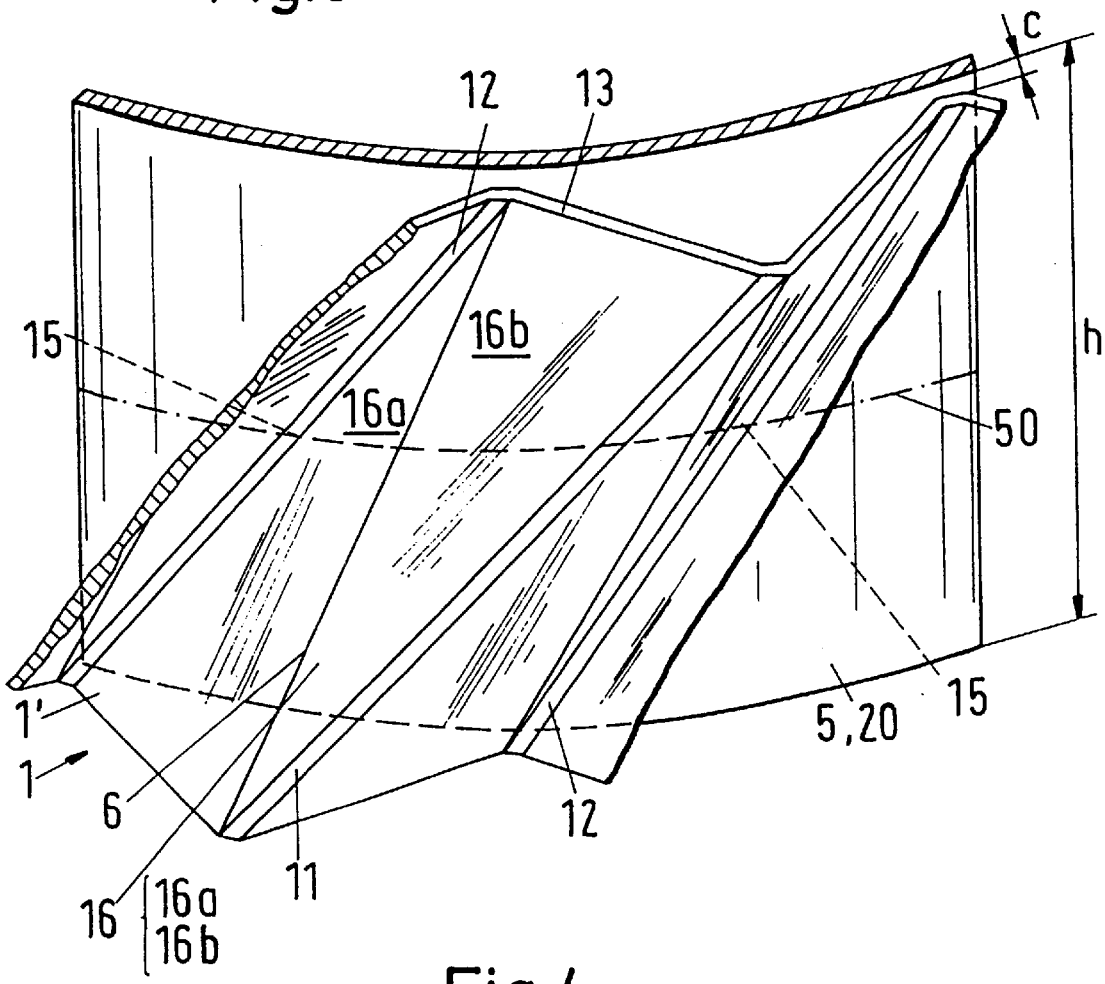
FIG. 3 illustrates a piece of a folded foil which is suitable for the forming of a layer of the mixer in accordance with the invention.

FIGS. 1 and 2 show an oblique view of the layers and a cross-section pertaining to a mixer in accordance with the invention with two concentric layers 1 and 2. The two layers 1 and 2, which form a mixer element 30 when taken together, are arranged in a ring space 3 between a jacket tube 10 and an inner tube 20. In FIG. 1 a central axis z and an angle $\phi$ (=azimuth) are drawn in. In FIG. 2 the widths of the layers 1 and 2 are designated by a and b respectively, the corresponding ring surfaces by A and B. The layers 1, 2 form a cross channel structure with openly crossing flow channels 14 and 24; a mixing takes place there. The channels 14' and 24' which are located at the edges impose an azimuthal relocation. Each layer 1, 2 extends over a surface which forms a closed periphery transverse to the axis z. The channels 14, 14', 24 and 24' respectively form in each case equivalent channels: They extend on an inner or outer side of the layer 1, 2 over equally long distances from a first to a second cross-section of the ring space, so that the channels impose an azimuthal velocity component 40 and 41 respectively onto the fluid mixture flowing through them which is largely equally great in all equivalent channels. Let it now be assumed that the central axis z is oriented horizontally and a gas/liquid mixture flows partly segregated into the mixer element 30. Thanks to the azimuthal velocity components 40 and 41 the gas phase is forwarded downwardly, the liquid phase upwardly, so that a mixing of the two phases results. An inhomogeneity decreases strongly thanks to the azimuthal velocity components 40 and 41.

The layers 1, 2 need not necessarily be completely closed along their periphery. It suffices for the layers to be formed of strips which are shaped into cylinders and the strip ends of which that extend in the axial direction in each case to form a joint. Instead of the joint a gap or an overlapping can also be present. A sheet metal can also be laid in between the layers 1, 2, so that the channels 14, 24 do not cross openly. In this case the fluid mixture is subdivided by the channels into differently directed partial flows; a mixing takes place after emergence from the mixer element 30.

The layers 1, 2 can be produced by folding of material strips. In this each folded strip is shaped into a cylinder which is completely or—up to but excluding a narrow open strip—nearly completely closed at a lateral joint which is oriented in the axial direction. The profilings of the layers 1, 2 is advantageously formed in such a manner that the channel walls fit onto one another at the named joint.

Figure 4:
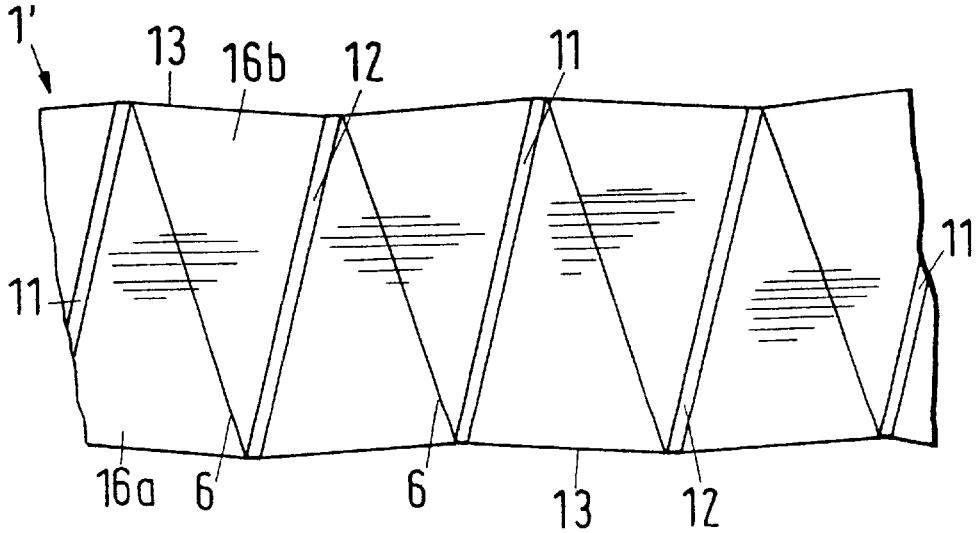
FIG. 4 illustrates the foil of FIG. 3 before the folding with drawn-in folding edges.

FIG. 3 shows a piece of a folded foil 1' which is part of a layer 1 of the mixer in accordance with the invention. The same foil (1') in the non-folded state is illustrated in FIG. 4. Between an outer folding edge 11 (illustrated as a double line) and an inner folding edge 12 (double line) there lies an approximately parallelogram-shaped piece of surface 16 in which the side edges which are formed by the folding edges 11 and 12 are only approximately parallel to one another. A diagonal folding edge 6 (single line) is provided in this piece of surface 16. The folding edge 6 divides the piece of surface 16 into two triangles 16*a* and 16*b* which lie between the edges 11 and 6 or 12 and 6 respectively. Thanks to the diagonal folding edge 6 the two triangles 16*a* and 16*b* are formed planarly. The other diagonal of the piece of surface 16 can also be chosen as folding edge.

With a correct choice of the dimensions, which can be calculated or determined using methods of descriptive geometry, the strip 1' of FIG. 4 can be folded in such a manner that the edges 12 make contact with a cylindrical surface 5 (for example the surface of the inner wall 20 in FIG. 2) on a circle 50 at points 15. Each edge 12 intersects the circle 50 at the same angle. The free ends 13 of the layer 1 and of the circle 50 lie on parallel planes (not illustrated), with respect to which the z-axis is perpendicular. In the unfolded state, see FIG. 4, the free ends 13 form a zigzag line.

In the folded state there is a gap at the end 13 between the folding edges 12 and the cylinder surface 5, the width of which that is measured perpendicular to the cylinder surface 5 being designated by c in FIG. 3. The smaller the height h of the layer 1 is, the smaller is c. The height h should be chosen so large that the edges 11 and 12 of the layers 1 and 2 respectively cross at least twice, so that the layers 1, 2 can be connected to one another at the crossing points. The named gap of width c should be as small as possible and as a consequence the height h should be short. In the embodiment of FIG. 1 this is not the case. Therefore a waisting of the layer 1 is easy to recognize. A waisting is admittedly always present; it should however be less pronounced than in FIG. 1. Through a suitable choice of the layer width a and of the angle of inclination of the folding edges 11, 12 an ideal height h can be determined.

Figure 5:
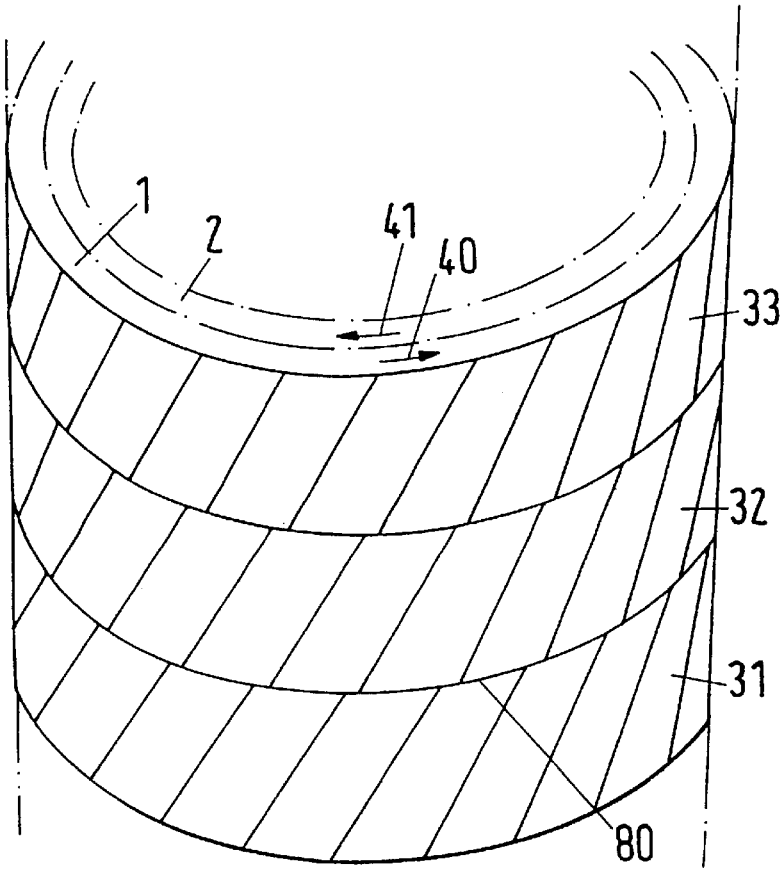
FIG. 5 illustrates a configuration with a plurality of mixer elements which form a mixer in accordance with the invention.
Figure 6:
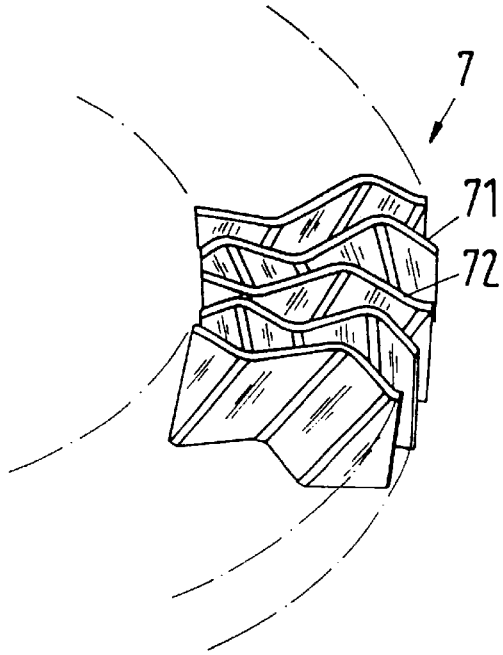
Fig.6 (Prior Art)
FIG. 6 illustrates a mixer element in accordance with the prior art which contains radial layers of a cross channel structure.

In order to achieve a good mixing action a large number of mixer elements 31, 32, 33 which have small heights h are arranged to follow one another axially: see FIG. 5. In order that a radial mixing is also possible, mixer elements 7 can be inserted which contain radial layers 71, 72 which likewise form a cross channel structure: FIG. 6. Mixer elements 7 of this kind are already known.

If the mixer in accordance with the invention comprises at least two mixer elements 31, 32 which are arranged one after the other, then these can be arranged to be azimuthally displaced with respect to one another. At the joint 80 (FIG. 5) of the mixer elements 31, 32 then there are passages from inner to outer channels or vice versa from outer to inner channels respectively between layers 1 which are adjacent in the axial direction. In an arrangement of this kind fluid flows from the outer into the inner channels and vice versa.

Figure 7:
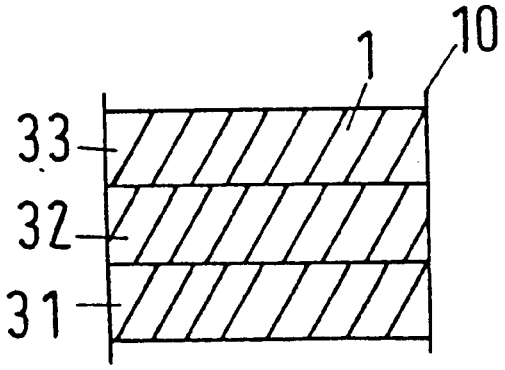
FIG. 7 is a highly simplified illustration of the configuration of FIG. 5, and FIGS. 8–10 illustrate further configurations of the present invention.
Figure 8:
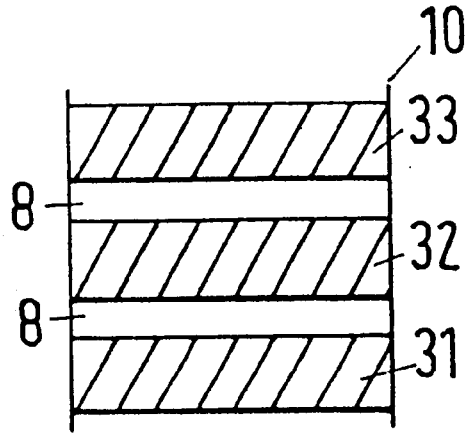

FIGS. 7–10 show in survey four different configurations, with that of FIG. 7 corresponding to the configuration which is illustrated in FIG. 5. FIG. 8 shows a configuration in which gaps 8 are left open between adjacent mixer elements of the elements 31–33. In these gaps 8 a radial mixing can take place. The length of the gap 8 is advantageously less than five times the radial width of the ring space 3.

Figure 9:
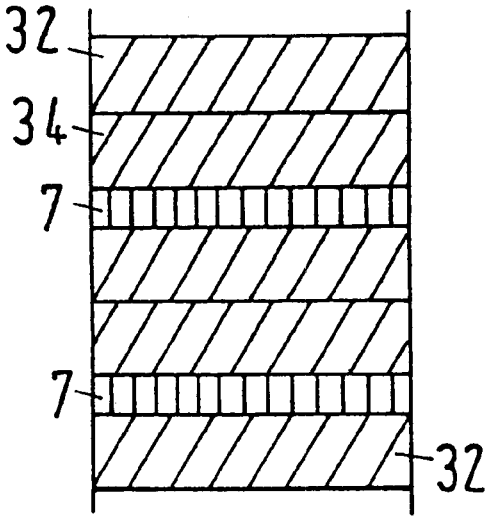
Figure 10:
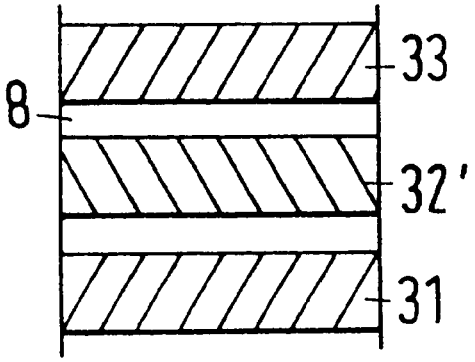

FIG. 9 represents a configuration in which in addition mixer elements 7 in accordance with FIG. 6 are provided. In FIG. 10 a configuration can be seen in which adjacent mixer elements 31, 32' or 32', 33 in each case have an oppositely inclined channel direction in corresponding layers 1 or 2 (cf. FIGS. 1, 5).

Obviously more than two layers 1, 2 can be provided in a mixer element 30. Their number is advantageously even, in particular when it is desired that the total angular momentum of the conveyed fluid be practically zero. In order that the total angular momentum largely vanishes, it is to be required in an even number of layers that the layers occupy sub-surfaces in a cross-section of the ring space which have at least approximately equally large areas for each layer. In the example of FIG. 2 the layer widths a and b must be chosen such that the ring surfaces A and B are of equal size.

The exemplary embodiments which are illustrated in the drawings show static mixers with channels of which the cross-sections are triangular. The profiles of the layers can also be corrugated or shaped differently; for example the channel cross-sections can be trapezoidal.

The mixer in accordance with the invention can advantageously be used in the axial transport of a fluid mixture through a ring space 3 if the fluid mixture 4 which is to be transported consists of phases of different density. In this, one or more groups of mixer elements can be provided which comprise in each case a plurality of identical mixer elements which are arranged to follow one upon the other. The central axis z can enclose an angle of inclination with respect to a horizontal plane which is less than 90° and which in the extreme case can even amount to 0°.

A use of the mixer in accordance with the invention is particularly suitable in a drilling for petroleum and/or natural gas. In this use a ring space of a drilling channel is equipped with installations of the static mixer which are arranged in a monitoring device, with the monitoring device being provided for a fluid mixture which flows through the ring space in order to carry out a measurement of phase components of the fluid mixture.

Examples of further possible uses are as follows:

a) Mixing of two fluids in a ring space, with at least one of the fluids being fed in in such a manner that a non-uniform concentration distribution is present over the periphery during entry into the ring space.

b) Temperature equalization in a gas turbine ahead of the infeed of the combustion gases to the turbine blades.

Carrying out a chemical reaction, for example a combustion, on the surface of a mixer structure which carries catalytically active material in the event that the reaction is to be carried out in a ring space.

What is claimed is:

1. A static mixer with profiled layers which are arranged in a ring space and which contain mutually crossing flow channels which are inclined relative to a central axis (z), wherein a fluid mixture is to be transported in the axial direction in the presence of a mixing action, wherein each layer extends over a surface which forms an at least substantially closed periphery transverse to the axis (z) and each layer comprises equivalent channels which extend on an inner or outer side of the layer over substantially equal distances from a first to a second cross-section of the ring space, so that each channel imposes an azimuthal velocity component onto the fluid mixture which flows through it which is substantially equally large for all equivalent channels;

wherein an approximately parallelogram-shaped piece of surface lies in the layers in each case between an outer and an inner folding edge; and wherein a diagonal folding edge is included in this piece of surface.

2. A static mixer in accordance with claim 1 wherein the ring space is bounded by at least one circular cylindrical surface.

3. A static mixture in accordance with claim 2 wherein the ring space is bounded by at least one circular cylindrical surface through at least one of the inner surface of a jacket tube and the outer surface of an inner tube.

4. A static mixer in accordance with claim 1 wherein the layers are arranged in a plurality of mixer elements which follow one another axially; and wherein gaps present between all or individual mixer elements, with the length of the gap being less than five times the radial width of the ring space.

5. A static mixer in accordance with claim 4, further comprising mixer elements that include radial layers with profilings that are arranged between all or individual mixer elements.

6. A static mixer in accordance with claim 1 wherein the layers are produced through folding of material strips and each folded strip is shaped into a cylinder, with the profiling being formed in such a manner that the channel walls fit onto one another at the ends of the strips which are oriented in the axial direction.

7. A static mixer in accordance with claim 1 wherein the number of layers is even; and wherein the layers occupy sub-surfaces (A, B) in a cross-section of the ring space which have substantially equally sized areas for each layer.

8. A static mixer in accordance with claim 7 wherein the number of layers is two.

9. A static mixer in accordance with claim 1, wherein the layers are arranged in a plurality of mixer elements, wherein at least two mixer element of the plurality are arranged one behind the other and in this are arranged to be mutually displaced azimuthally, so that there are passages from inner to outer channels or vica versa from outer to inner channels respectively at a joint of the mixer elements between layers which are adjacent in the axial direction.

* * * * *